United States Patent [19]

Desai

[11] Patent Number: 4,511,051

[45] Date of Patent: Apr. 16, 1985

[54] CHILD-RESISTANT PACKAGE WITH TAMPER INDICATING DEVICE

[75] Inventor: Kirit C. Desai, Perrysburg, Ohio

[73] Assignee: Owens-Illinois, Inc., Toledo, Ohio

[21] Appl. No.: 612,498

[22] Filed: May 21, 1984

[51] Int. Cl.[3] ..... B65D 55/02

[52] U.S. Cl. ..... 215/225

[58] Field of Search ..... 215/216, 224, 225, 250, 215/253

[56] References Cited

U.S. PATENT DOCUMENTS

| | | | |
|---|---|---|---|
| 4,071,156 | 1/1978 | Lowe | 215/224 |
| 4,341,318 | 7/1982 | Smalley | 215/225 |
| 4,375,859 | 3/1983 | Fillmore | 215/224 |
| 4,433,790 | 2/1984 | Gibson | 215/225 |
| 4,449,639 | 5/1984 | Davis | 215/224 |
| 4,457,437 | 7/1984 | Heath, Jr. | 215/224 |

*Primary Examiner*—George T. Hall

*Attorney, Agent, or Firm*—John R. Nelson; Steve M. McLary

[57] ABSTRACT

A child-resistant package with a snap-on closure comprising a container having a neck finish including an annular retaining bead having at least one notch therein, a closure having a top and a peripheral skirt, the skirt having a lifting tab on the outer surface thereof and a first radially inwardly extending locking lug on the inner surface thereof adjacent the external lifting tab. The skirt includes a portion defining a tamper indicating tab having a radially inwardly extending lug thereon spaced circumferentially from the locking lug on the closure such that when the locking lug is aligned with a notch in the first annular bead, the closure cannot be removed until the tab portion of the band having the lug thereon is severed from the skirt of the closure and freeing the closure so that the lug on the tab portion will not interfere with removal of the closure.

20 Claims, 7 Drawing Figures

CHILD-RESISTANT PACKAGE WITH TAMPER INDICATING DEVICE

This invention relates to child-resistant packages and particularly child-resistant packages of the snap-on closure type.

BACKGROUND AND SUMMARY OF THE INVENTION

One common type of child-resistant closure that has been utilized in the arrangement, such as shown in U.S. Pat. No. 3,871,662, wherein the container has an annular bead thereon with at least one notch therein and the closure has a locking lug on the skirt thereof which must be brought into alignment with the notch to remove the closure by an upward force.

Although tamper indicating devices for other types of packages have been heretofore proposed, applicant is not aware of any that have been proposed for use in the snap-on type closures.

Among the objectives of the present invention are to provide a tamper indicating device for such child-resistant packages.

In accordance with the invention, the child-resistant package with a snap-on closure comprises a container having a neck finish including an annular retaining bead having at least one notch therein, a closure having a top and a peripheral skirt, the skirt having a lifting tab on the outer surface thereof and a first radially inwardly extending locking lug on the inner surface thereof adjacent the external lifting tab. The skirt includes a portion defining a tamper indicating tab having a radially inwardly extending lug thereon spaced circumferentially from the locking lug on the closure such that when the locking lug is aligned with a notch in the first annular bead, the closure cannot be removed until the tab portion of the band having the lug thereon is severed from the skirt of the closure freeing the closure so that the lug on the tab portion will not interfere with removal of the closure.

DESCRIPTION

Figure 1:
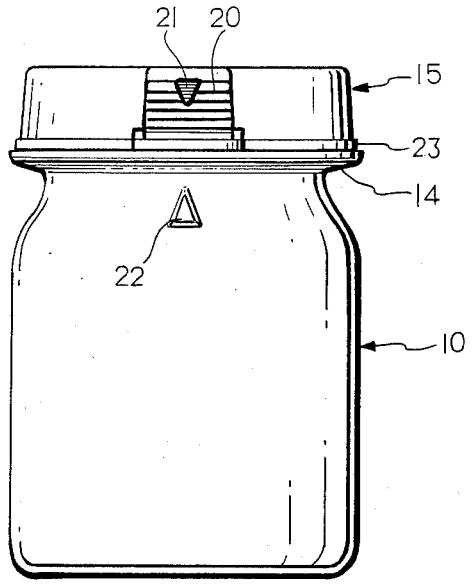
FIG. 1 is an elevational view of a child-resistant package embodying the invention.
Figure 2:
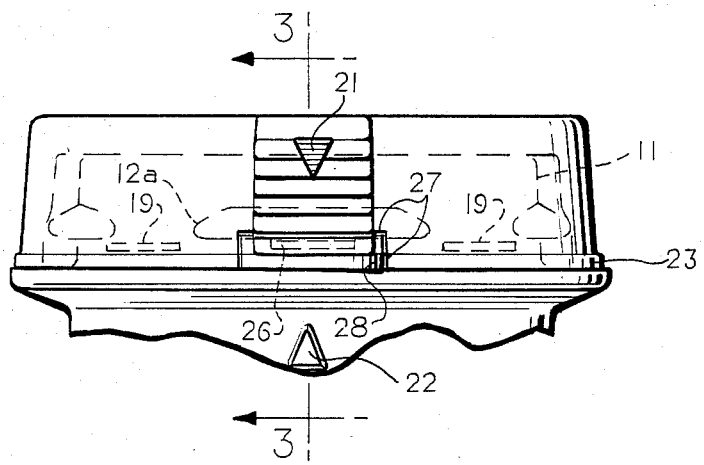
FIG. 2 is a fragmentary elevational view on an enlarged scale of a portion of the package.
Figure 3:
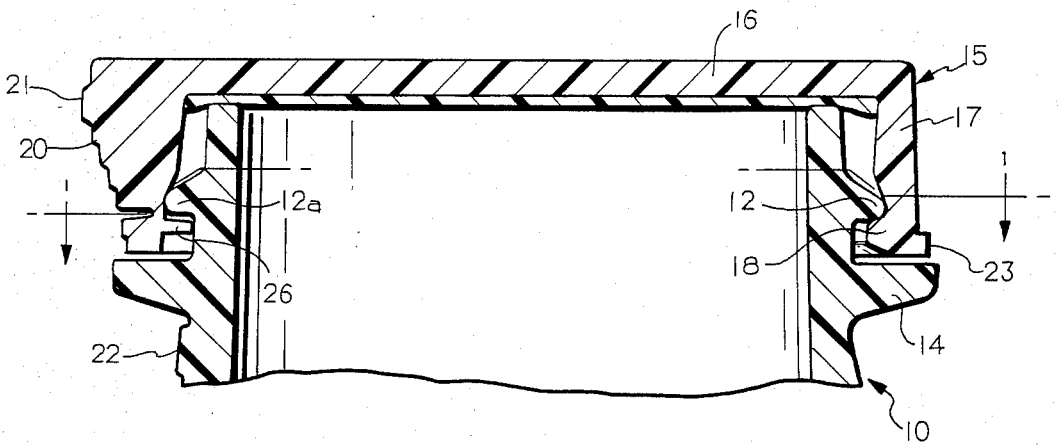
FIG. 3 is a fragmentary vertical sectional view of the child-resistant package taken along the line 3—3 in FIG. 2.
Figure 4:
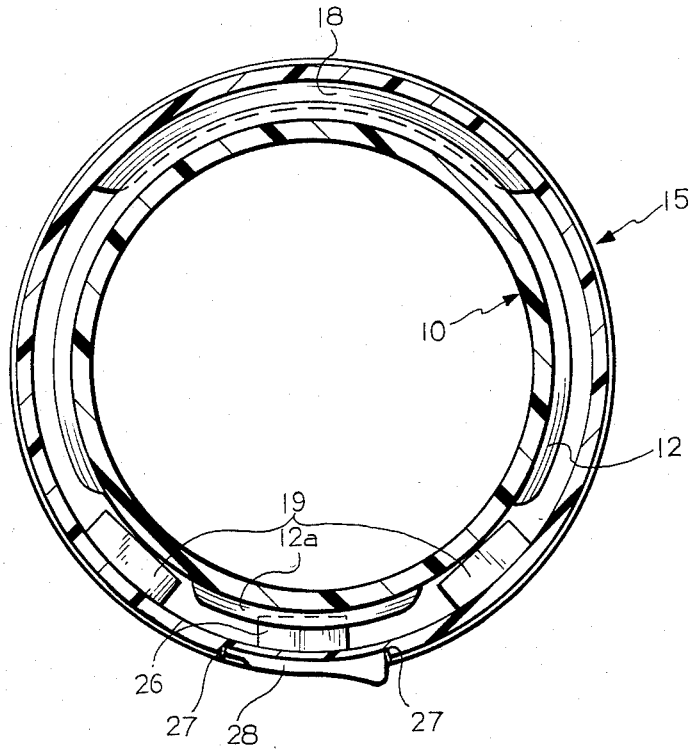
FIG. 4 is a fragmentary sectional view of the package taken along the line 4—4 in FIG. 3.
Figure 5:
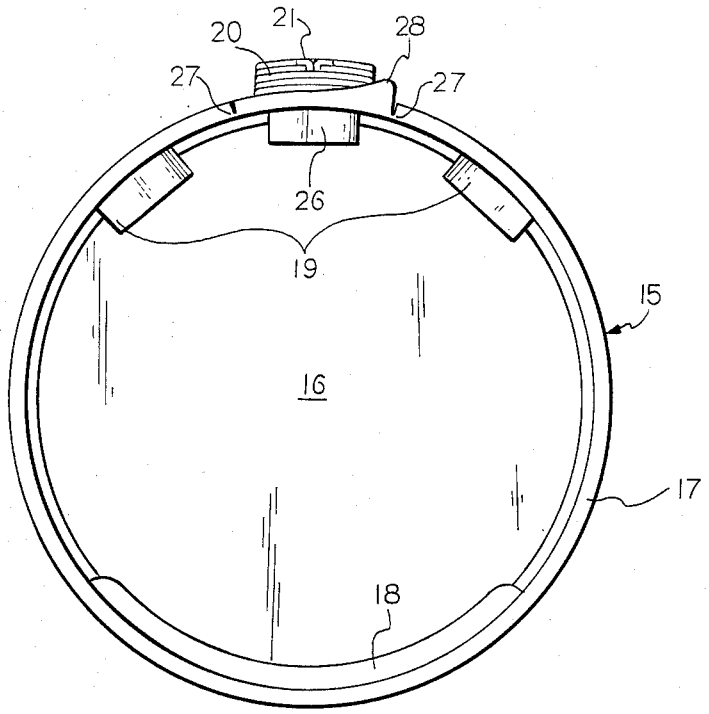
FIG. 5 is a bottom plan view of the closure.
Figure 6:
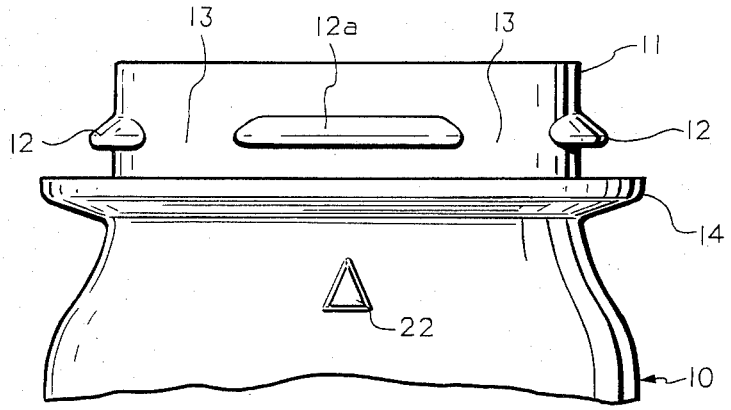
FIG. 6 is a fragmentary elevational view of the container.
Figure 7:
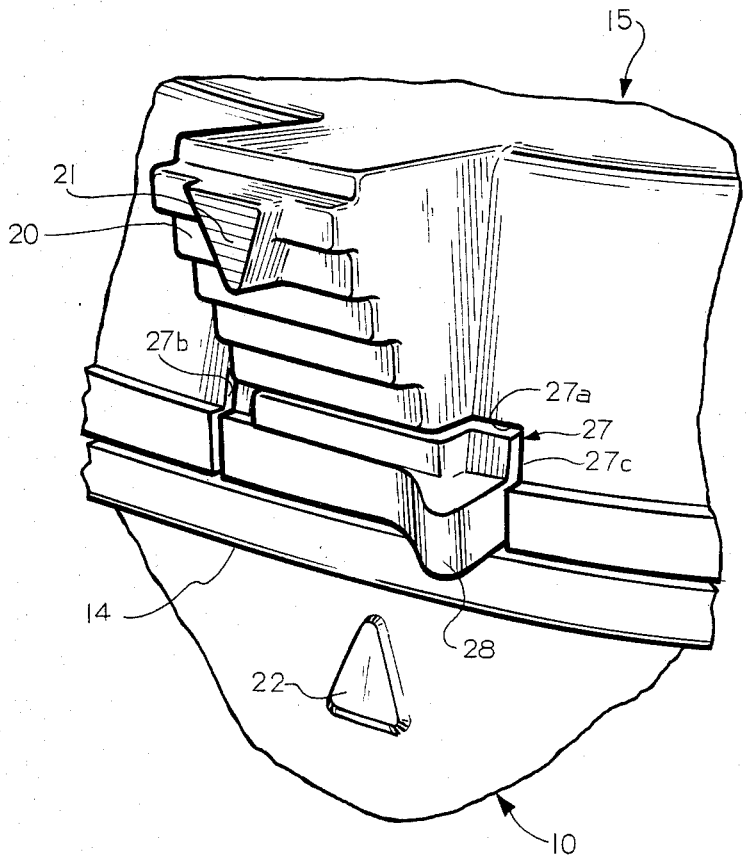
FIG. 7 is a fragmentary perspective view on an enlarged scale of the package.

Referring to FIGS. 1–6, the child-resistant package is of conventional construction in that it includes a container 10 having a neck 11 with at least one arcuate interrupted bead 12 and a pair of notches 13 in the periphery of the bead 12 and a flange 14 beneath the bead 12. A closure 15 includes a top wall 16 and a peripheral skirt 17. A first locking lug 18 extends circumferentially on the inside of skirt 17 of the closure 15 and is adapted to engage below the bead 12. A pair of locking lugs 19 are also provided on the inside of skirt 17 and are adapted to engage beneath the bead 12. A lifting tab 20 is provided on the exterior of the skirt 17 circumferentially between the locking lugs 19. When the lugs 19 are aligned with the notches 13, then the closure 15 can be removed by an upward tilting movement on the lifting tab 20. Complementary indicia 21, 22 are provided on the closure 15 and container 10, respectively, to indicate the proper alignment.

In accordance with the invention, the skirt 17 of the closure 15 includes a portion 23 that is connected to the remainder of the skirt of the closure by weakened portions 27 such as a thin connecting portion formed by a groove. The portion 23 further includes a radially inwardly extending locking lug 26 disposed on the portion 23 between the weakened perimeter 27 spaced circumferentially between the locking lugs 19 on the closure and adapted to project radially into a position between the notches 13 and below the central portion 12*a* of bead 12 so that even though the lugs 19 on the closure are aligned with the notches 13, the lug 26 on the band 23 will prevent the closure from being removed.

In order to facilitate removal of the tamper indicating band, the band is formed with a vertical line of weakness an by a portion 27, which has a transverse portion 27*a* and axial portions 27*b*, 27*c* of thin cross section and a radially extending tab 28 so that the portion 23 can be broken along weakened line 27 and then removed from the closure. After the portion 23 is removed, there is obviously an indication that there has been intentional or inadvertent tampering with the contents. Removal of portion 23 also removes locking lug 26 freeing the closure 15 for snap-cap type removal from the bead 12, 12*a*.

After the tab portion 23 is removed the closure 15 can be operated in the conventional manner.

Alternatively, weakened line portion 27*b* can be eliminated whereby the tab portion is moved away from the bead 12*a* but remains attached to the closure.

I claim:

1. A child-resistant package with a snap-on closure comprising a container having a neck finish, said neck finish including a retaining bead having at least one notch therein, a closure having a top and a peripheral skirt, a first radially inwardly extending locking lug on the inner surface of said skirt adapted to be aligned with said notch to permit removal of said closure, said skirt having a portion with a radially inwardly extending lug thereon spaced circumferentially from said locking lug on said closure and underlying said first mentioned bead on said container such that when the first mentioned locking lug is aligned with a notch in the annular bead, the closure cannot be removed until the portion of the skirt having the lug thereon is moved away from its relationship with the remainder of the skirt of the closure and in order that the lug thereon will not interfere with removal of the closure.

2. The child-resistant package set forth in claim 1 wherein said portions of said skirt has weakened portions connecting said portion to the remainder of the closure.

3. The child-resistant package set forth in claim 2 wherein said portion includes an axial weakened portion whereby a free end can be provided on the portion by pulling outwardly to facilitate severing of the portion from the closure.

4. The child-resistant package set forth in claim 1 wherein said portion of said skirt is connected by a line of weakness which is generally inverted U-shaped.

5. The child-resistant package set forth in claim 4 wherein said line of weakness includes a transverse portion and axial portions.

6. The child-resistant package set forth in claim 5 including a finger engaging lifting tab on said portion.

7. The child-resistant package set forth in claim 1 wherein said closure includes a locking lug generally diametrically opposite from the portion of the skirt and adapted to engage a portion of the container.

8. The child-resistant package set forth in claim 1 wherein said annular bead includes a second notch, said skirt of said closure having a second locking lug, said portion of said skirt being interposed circumferentially between said two notches, such that when said portion of the skirt is positioned intermediate the two notches, the locking lugs are brought into registry with the notches so that the closure can be removed by upward force on the lifting tab if the portion is moved away from a bead of the container.

9. A child-resistant snap-on closure for a container having a neck finish including an annular retaining bead having at least one notch therein, said closure having a top and a peripheral skirt, a first radially inwardly extending locking lug on the inner surface thereof, said skirt including a portion extending downwardly and defining a tamper indicating band, said skirt having a portion with a radially inwardly extending lug thereon spaced circumferentially from said locking lug on said closure such that when the first mentioned locking lug is aligned with a notch in the bead on a container, the lug on the portion of the skirt will underlie a bead on a container and closure cannot be removed until the portion of the skirt having the lug thereon is moved away from its relationship with the remainder of the skirt of the closure and in order that the lug thereon will not interfere with removal of the closure.

10. The child-resistant closure set forth in claim 9 wherein said portion of said skirt has weakened portions connecting the portion to the remainder of the closure.

11. The child-resistant closure set forth in claim 10 wherein said portion includes an axial weakened portion whereby a free end can be provided on the portion by pulling outwardly to facilitate severing of the portion.

12. The child-resistant closure set forth in claim 9 wherein said portion of said skirt is connected by a line of weakness which is generally inverted U-shaped.

13. The child-resistant closure set forth in claim 12 wherein said line of weakness includes a transverse portion and axial portions.

14. The child-resistant closure set forth in claim 13 including a finger engaging lifting tab on said portion.

15. The child-resistant closure set forth in claim 9 wherein said closure includes a locking lug generally diametrically opposite from the portion of the skirt and adapted to engage a portion of the container.

16. The child-resistant closure set forth in claim 9 wherein said skirt of said closure has a second locking lug adapted to be aligned with a second notch in a bead of the container, said portion of said skirt being interposed circumferentially between said two notches, such that when said portion is positioned intermediate the two notches, the locking lugs are brought into registry with the notches so that the closure can be removed by upward force on the lifting tab if the portion of the skirt is moved away from a bead of the container.

17. In a snap-cap closure wherein the closure has a locking lug on the skirt thereof which must be brought into alignment with a notch in an annular bead on the container in order to remove the closure by an upward force, the improvement comprising a weakened line of severance on the skirt defining a portion that can be served, and a second locking lug on said portion which is adapted to engage a bead on the container when the first mentioned locking lug is aligned with the notch such that the closure cannot be removed until the portion of the skirt having the lug severed along the weakened line so that the portion can be moved radially away from the remainder of the skirt of the closure in order that the second locking lug thereon will not interfere with the removal of the closure.

18. The closure set forth in claim 17 wherein said portion of said skirt is connected by a line of weakness which is generally inverted U-shaped.

19. The closure set forth in claim 18 wherein said line of weakness includes a transverse portion and axial portions.

20. The closure set forth in claim 19 including a finger engaging lifting tab on said portion.

* * * * *